United States Patent [19]
Andreoli

[11] 3,934,521
[45] Jan. 27, 1976

[54] COMBUSTION APPARATUS

[75] Inventor: Bruno Andreoli, Affoltern a. Albis, Switzerland

[73] Assignee: Von Roll AG, Gerlafingen, Switzerland

[22] Filed: Dec. 19, 1974

[21] Appl. No.: 534,171

[30] Foreign Application Priority Data

Feb. 14, 1974 Switzerland ..... 2105/74

[52] U.S. Cl. ..... 110/15; 110/38; 110/72 R; 110/75 R

[51] Int. Cl.² ..... F23G 5/04; F23B 1/20; F23L 9/06

[58] Field of Search ..... 110/8 R, 15, 38, 72 R, 110/75 R

[56] References Cited

UNITED STATES PATENTS

| | | | |
|---|---|---|---|
| 1,518,024 | 12/1924 | Urquhart | 110/38 |
| 2,701,536 | 2/1955 | Miller | 110/8 X |
| 3,212,465 | 10/1965 | Cates, Jr. et al. | 110/38 |
| 3,395,655 | 8/1968 | Guy | 110/75 |
| 3,431,872 | 3/1969 | Stefanyk | 110/72 |
| 3,863,578 | 2/1975 | Kato et al. | 110/38 |

*Primary Examiner*—Kenneth W. Sprague
*Attorney, Agent, or Firm*—William R. Woodward

[57] ABSTRACT

An incinerator comprises a pre-drying grate, a combustion grate or drum following the pre-drying grate, and a drop intermediate the pre-drying grate and the combustion grate or drum. The drop is the front wall of an air distribution box extending over the width of the pre-drying grate, this wall including air through-flow apertures whereby air passes from the box to a combustion chamber above the combustion grate or drum. The speed of the air flow from the apertures varies over the wall, with the highest speed flows being adjacent to the side walls of the chamber.

39 Claims, 18 Drawing Figures

COMBUSTION APPARATUS

FIELD OF THE INVENTION

The invention relates to a combustion apparatus, more particularly an incinerator for the burning of refuse.

DESCRIPTION OF THE PRIOR ART

A known incinerator for the burning of refuse comprises a pre-drying grate, a combustion device, and an air-cooled, stepped, grate drop arranged at the end of the grate, down which the material to be combusted descends suddenly onto the combustion device which follows the grate.

In known incinerators of this kind wherein, as is known, the combustion device arranged downstream of the grate is formed either by a combustion grate or by a rotating combustion drum, in spite of the intensive efforts which the technical world has made for a long time, there are still the important disadvantges that, owing to the continually fluctuating composition of the refuse, the firing action in the region of the combustion device in non-uniform and also the material is not completely burned, and at the side walls, especially in the vicinity of the grate drop, slag accretions readily occur, and over the combustion chamber instead of having as uniform a temperature as possible, high temperature peaks occur locally, whereby those constructional parts of the incinerator affected thereby are subjected to very high thermal stress, which reduces the working life of these parts.

In an already known incinerator of the kind initially mentioned, the pre-drying grate is constructed as a mechanical feed grate, and the stepped grate drop is formed by a relatively steeply descending, so-called "drop grate" down which the refuse for burning descends suddenly to a horizontal combustion grate, a so-called "furnace bottom grate," the drop grate being cooled by combustion-supporting air supplied to it as an under-grate blast, with simultaneous preheating of this air (Swiss Pat. Specification No. 231,039).

SUMMARY OF THE INVENTION

The invention has as its object to eliminate the aforesaid disadvantages in as simple, inexpensive and reliable a manner as possible.

According to the present invention, there is provided a combustion apparatus, comprising a grate, a combustion device following the grate, a combustion chamber above said device, and a drop which is intermediate the grate and the combustion device and down which material to be combusted falls, wherein the improvement comprises forming at least part of said drop as a front wall of an air distribution box extending over substantially the whole width of the grate and connected to air supply means for supplying air to said box, the outer surface of said wall facing said combustion chamber, and said wall being provided with air throughflow apertures forming zones of different air speed when air passes from said box to said chamber.

The size and distribution of the throughflow apertures is such as to provide zones of higher speed air flow along the side walls of the chamber and an intermediate zone of lower speed air flow. In one form of the invention, a zone of medium speed air flow, at the top of the chamber between the two lateral zones of higher speed air flow and of the zone of lower speed air flow.

In a preferred construction, the front wall of the box is constructed as a hollow wall, whose rear part comprises plates provided with a first set of the throughflow apertures and whose front part is composed of cast front plates spaced from one another to leave free gaps around their edges, forming another set of the throughflow apertures. One or both of these sets of apertures may be used for establishing the desired air speed zones by making the apertures larger where the air speed is to be greater. The plates of the rear part of the hollow wall in this preferred form of construction are detachably fastened to a supporting frame of the air distribution box and the plates of the front part are removably hung on horizontal support rods mounted on the box frame. The plates of the rear part of the wall preferably have throughflow apertures in the form of vertical slots, in which case the plates of the front part are provided with horizontal cooling ribs extending towards the interior of the hollow wall. The rear wall of the box is preferably provided with removable panels, on one of which an air supply means is connected. Vertical air partition means, either a single one in V-form provided with perforations or separate partitions, are arranged in the air distribution box to direct the flow of air and preferably vertical partitions are also provided in the hollow wall between the air speed zones. Where vertically adjacent zones of different air speed are used in the mid-portion of the front wall of the box, horizontal partitions may similarly be used.

In another form of construction, the air distribution box is formed of a single bent metal plate or sheet provided with end walls and open at the front and cast front wall plates are hung in front of the opening having air throughflow apertures in the form of horizontal slots protected with an overhanging brow formed on the front plates.

The combustion device, at the bottom of the chamber, in front of the front wall of the air box, may comprise a second grate or it may comprise instead a rotatable drum. Instead of a single drop between the pre-drying grate and the combustion device, there may be a first drop between the pre-drying grate and a combustion grate, followed by a second drop leading to another combustion grate or to a rotatable drum, both drops being, in this case, air-colled, a second air distribution box being provided across the full width of the second drop, in the same manner as the first air distribution box is located behind the first drop, with its apertured front wall providing the desired air flow.

The air supply means may be divided into two or more portions individually controlled for operating the desired air speed zones.

Further details are given in the following decription of the invention.

BRIEF DESCRIPTION OF THE DRAWINGS

In order that the invention may be more clearly understood, reference is made to the accompanying drawings, wherein.

DESCRIPTION OF THE PREFERRED EMBODIMENTS

Figure 1:
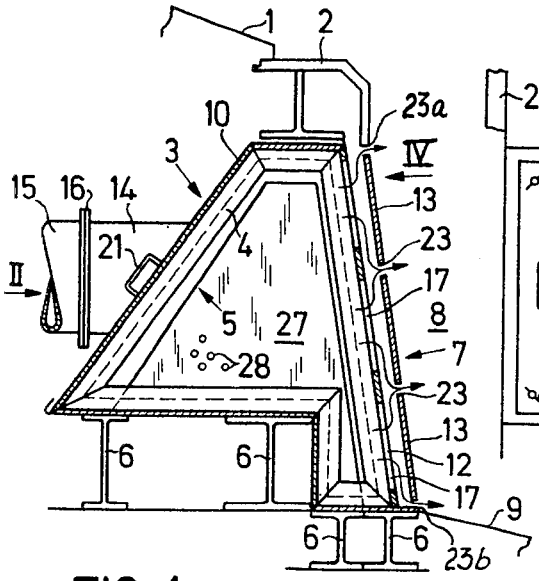
FIG. 1 shows a longitudinal vertical section through an incinerator, in particular through a discharge region of a pre-drying grate thereof, an air distribution box forming a drop thereof, and an entry region of a combustion device thereof.

In FIG. 1 is seen the discharge end 1 of the predrying grate which is constructed as any suitable kind of inclined grate or mechanical step or feed grate. Below a discharge shoulder of the grate 1 in the form of a discharge beam 2 there is arranged an air distribution box 3 whereof the length dimension extends trasversely to the longitudinal axis of the grate 1 over substantially its entire width *g* 1 (see FIGS. 3, 7 and 11). Here, the air distribution box 3 includes a skeleton frame made from T-section members 4 welded together, and the box is mounted on I-sections 6 belonging to the incinerator structure. A front wall 7 of the distribution box 3 adjacent the combustion chamber 100 (see FIG. 7) and provided with air throughflow apertures 17, 17*a* and 23 and slightly inclined relative to the vertical, forms a grate drop 8 down which the material to be burned descends suddenly on to a combustion device 9 which follows the pre-drying grate 1 and which is here also constructed as an inclined grate. Flat box walls of steel plate are so secured to the frame 5 that the air distribution box 3 which is thus formed is closed on all sides in an air-tight manner except for air inlet and outlet apertures. These flat box walls are at least partly removable from the frame 5. The air distribution box 3 comprises the shape and dimensions of a conventional brickwork grate drop such as is used more particularly in refuse incinerators. The rear wall 10 of the air distribution box 3 is inclined and is subdivided into three portions 11 which are constructed as detachable covers and are suspended on the frame 5 (see FIG. 2). Inside the box 3 there are mounted vertical air guiding and distributing partitions 27 in the form of steel plates provided with air throughflow holes 28 (see FIG. 7). The front wall 7 is constructed as a hollow wall and comprises rear vertically or horizontally slotted plates 12 and front plates 13 spaced therefrom. A suspension structure, not shown in FIG. 1 in order to leave the illustration clear, is welded securely to the frame 5 of the box 3 and is used for the suspension of the front plates 13 which are spaced apart from one another. The central rear wall cover 11 is provided with a rearwardly projecting pipe union 14 the axis of which lies in the central vertical longitudinal plane of the grate 1 and to which there is connected by means of a flange connection 16 an air inlet conduit 15. The air introduced through conduit 15 into the box 3 flows through vertical slots 17 and 17*a* of the slotted plates 12 and posses through free spaces 23 between the front plates 12 and passes through free spaces 23 between the front plates 13 and through spaces 23*a*, 23*b* and 23*c* (FIG. 4) at the top, bottom and sides of the plate array into the combustion chamber 100 where the air is used, in a heated condition owing to its cooling of the grate drop 8, as preheated combustion-supporting air and for cooling the brickwork.

Figure 2:
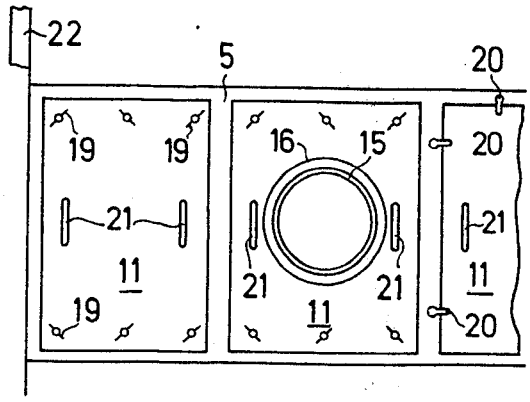
FIG. 2 shows a rear elevation of the air distribution box taken in the direction of arrow II of FIG. 1.

FIG. 2 shows the inclined rear wall 10 of the box 3 which comprises the three covers 11. These three covers are provided with asbestos seals, and are locked closed by wing nuts 19 or locking bolts 20. They comprise handles 21 so that they can easily be detached from the box 3. This allows easy access for operations within the box 3, so that the air guiding and distributing means provided in its interior can easily be adapted to particular conditions.

Figure 3:
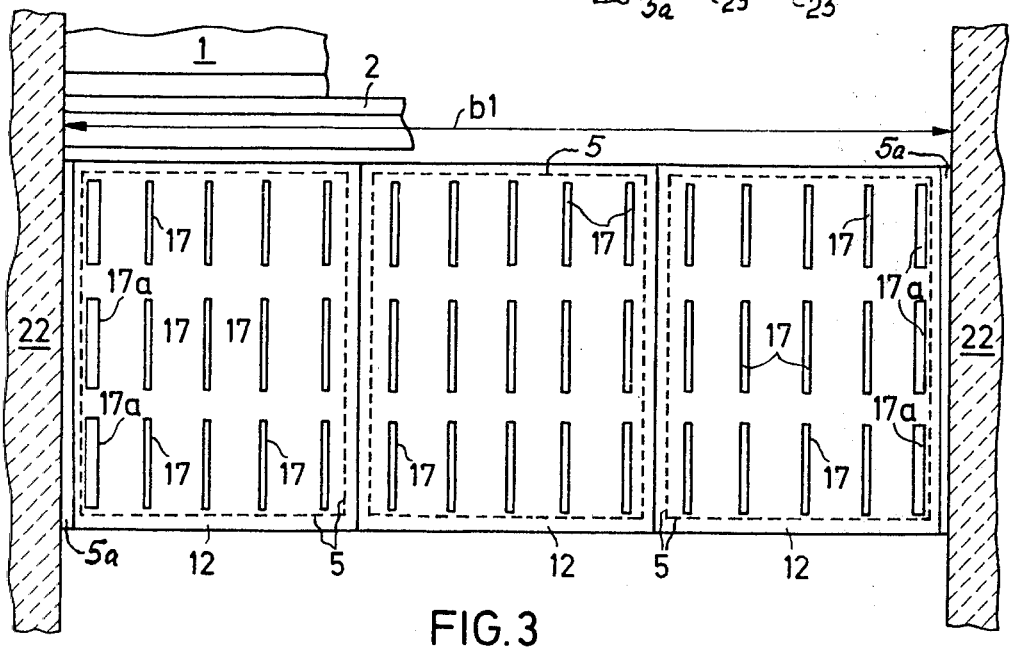
FIG. 3 shows a front elevation of the front wall of the air distribution box in the absence of the removable front plates 13 and with the suspension members 26 for the front plates 13 omitted.

FIG. 3 shows the slotted plates 12 from the front of the box 3. Here, the slotted plates are arranged in a common plane and attached securely by screwing to the frame 5 so that, by detaching these plates, the interior of the box 3 is also accessible from the front, i.e. from the combustion chamber 100. In addition to the vertical slots 17 which are identical to one another as regards length and width, there are arranged in the regions of the incinerator side walls 22 the slots 17*a* of greater width through which the air is blown along the masonry of the side walls 22 and cools the masonry. Owing to their considerably greater width, with identical slot length to the slots 17, the quantity of cooling air blown out through the slots 17*a* is correspondingly greater. Thus, over the width of the grate drop 8, different zones are formed with varying air quantity and speed, as will be discussed in more detail hereinafter with reference to FIG. 11.

Figure 4:
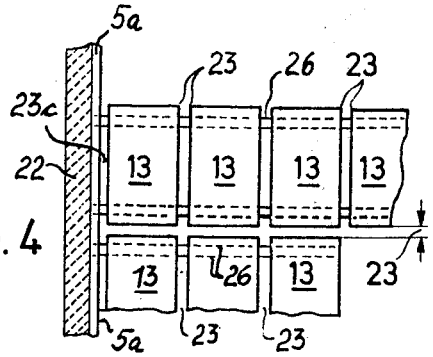
FIG. 4 shows a fragmentary front elevation of the front wall taken in the direction of the arrow IV of FIG. 1, with the front plate in place.

FIG. 4 shows the front surface of the grate drop 8 with the front plates 13 which consist for example a high-alloyed, heat-resistant cast steel. The front plates 13 are so suspended on the suspension structure welded to the frame 5 that all round each rectangular front plate 13 there remains free a relatively narrow slot-like throughflow aperture 23 which is for example about 5 to 10 mm. in width and extends horizontally and vertically. The front plates 13 cover the entire front surface, facing towards the combustion chamber, of the grate drop (see FIG. 1) and are arranged in three transverse rows one above another (see FIG. 1). The front plates 13 are supplied with the cooling air at their rear sides, this cooling air flowing through the slots 17 and 17*a* of the slotted plates 12 into the hollow space in the front wall 6 of the box (see FIG. 1 and FIG. 7). To increase the cooling effect, the front plates 13 are provided at their rear sides with cast-on ribs as will be explained in more detail with reference to FIGS. 5 and 6.

Figure 5:
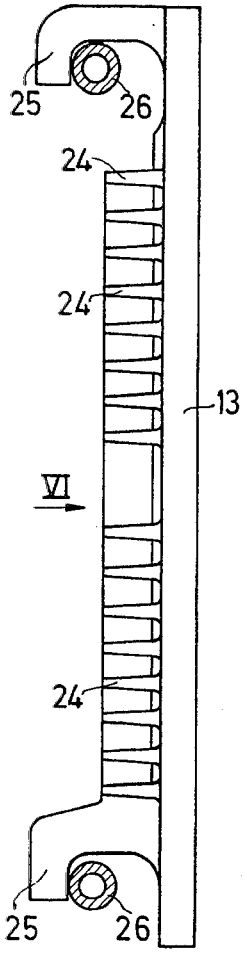
FIG. 5 shows a sectional side elevation of a gront plate of the front wall.

In FIG. 5 a front plate 13 is shown in side view. The front plate comprises cast-on, rearwardly projecting ribs 24 which extend horizontally (see FIG. 6), whereas the slots 17 and 17*a* of the slotted plates 12 extend vertically, which results in a lively whirling movement of the cooling air in the hollow interior of the front wall 7 between the slotted plate 12 and the front plates 13. Thus turbulent flow is produced at the rear sides of the front plates 13, which are heated to a high temperature by the heat from the combustion chamber, and this turbulent flow substantially increases the rate of heat transfer (kcal/m²h°C) and thus also the cooling effect. Hook-like projections 25 are cast on the rear side of each front plate 13 and are used for attaching the latter to the suspension structure welded to the frame 5.

Figure 6:
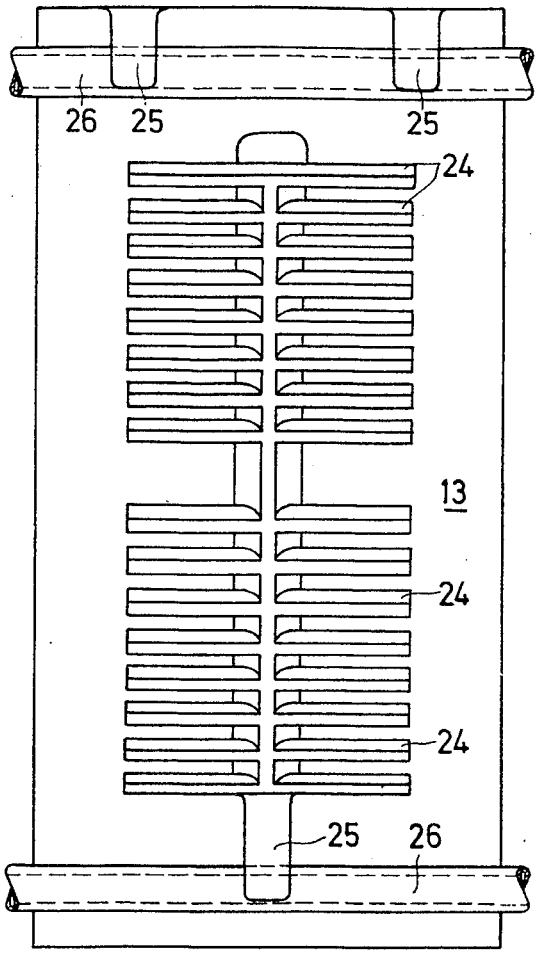
FIG. 6 shows a rear elevation of the front plate taken in the direction of the arrow IV of FIG. 5.

FIG. 6 shows that at the upper region of the rear side of the front plate 13 there are provided two hook-shaped cast-on projections 25 by means of which the front plate is hooked onto a tube 26 of the suspension structure. The tubes 26 are welded onto forwardly projecting flanges 5*a* at the sides of the array of slotted plates 12, i.e., extending along the wall 22 and affixed to the frame 5. At the lower region of the front plate 13 only a single, central, rear-wardly projecting suspension hook 25 is cast-on, this engaging over another horizontal tube 26 of the structure. Therefore the front plate 13 can be removed from the suspension structure by lifting it and then pulling it forwards, such ready removal being important for easy replacement of worn front plates by new plates. It should be noted that the front plates 13 do not require for fastening them any additional securing elements such as for example screws, locking bolts or clips.

Figure 7:
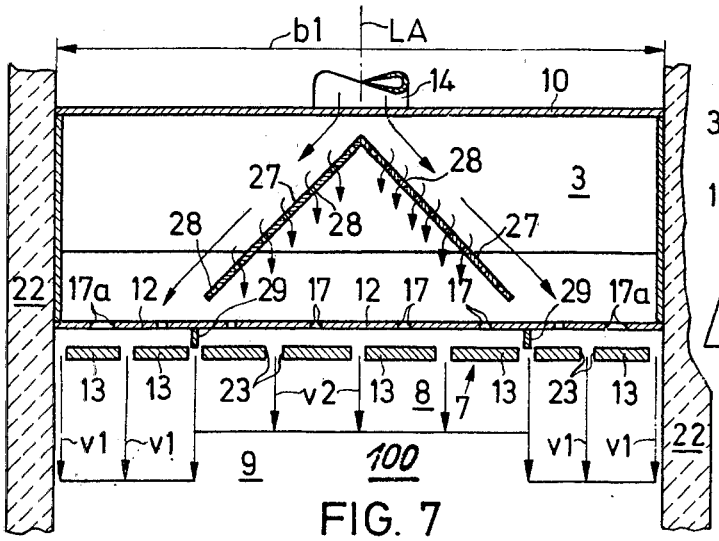
FIG. 7 shows a horizontal section through the air distribution box.

FIG. 7 shows that the two air guiding and distributing partitions 27 are arranged at an angle to each other, and also that there are two vertical partition plates 29 in the hollow wall 7, so that in the combustion chamber 100 above the combustion grate 9, which is used as an after-burning grate, there are formed over the width thereof three zones with air speeds v1 and v2. Situated respectively at the two side walls 22 of the incinerator are two laterally outer zones with a greater air speed v1 than the air speed v2 in the middle zone. This takes into account the fact that the two outer zones require an additional quantity of air to cool adequately the masonry of the two walls 22, whereas in the middle zone it is simply necessary to supply a quantity of air for cooling the front plates 13 and for the secondary air requirements for after-burning.

Thus in the combustion chamber 100 there is formed, in front of the grate drop 8, a so-called "speed profile" which is represented in FIG. 7 by different lengths of speed vectors *v*1 and *v*2. Further details of this speed profile will be explained later in connection with FIG. 11. The two partition plates 29 are each arranged in a vertical plane so that the hollow interior of this front wall is divided, between the slotted plates 12 and the front plates 13, into three adjacent chambers which correspond in their widths to the three zones in the combustion chamber. These two vertical partition plates 29 can comprise for example angle irons and can be secured for example to the slotted plates 12, for example by screwing.

Figure 8:
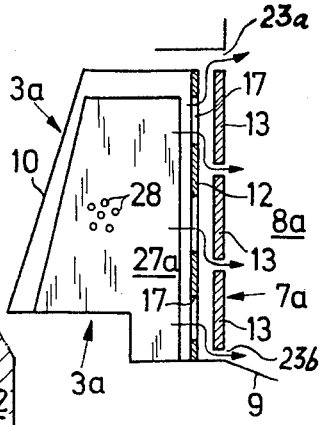
FIG. 8 shows a longitudinal vertical section through a modified version in which the air distribution box has a vertical front wall.

FIG. 8 shows a version in which the air distribution box 3*a* has a vertical front wall 7*a*. The vertical grate drop formed thereby is designated as 8*a* and the air guiding and distributing plates as 27*a*. Otherwise the construction and arrangement of the incinerator is the same as already explained with reference to FIGS. 1 to 7.

Figure 9:
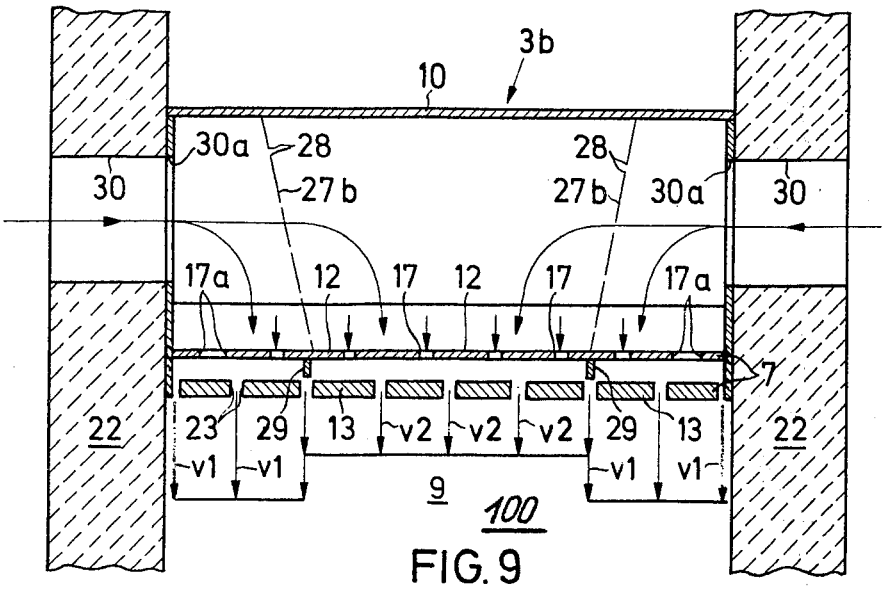
FIG. 9 shows a horizontal section through another modified version in which the air distribution box has lateral air supply.

FIG. 9 shows a version in which the air distribution box 3*b* has lateral air supply through inlet apertures 30 and 30*a* in the two side walls 22 of the incinerator and the two end walls of the box 3*b*. Two air guiding and distributing partitions 27*b* constructed as perforated steel plates and spaced from one another act as vertical partitions dividing the interior of the box 3*b* into three chambers and again form, in conjunction with the two vertical partition plates 29, in front of the grate drop 8 in the combustion chamber 100, three zones of which two laterally outer zones in the vicinity of the incinerator side walls 22 have a higher air speed *v*1 than the middle zone which has the speed *v*2.

Figure 10:
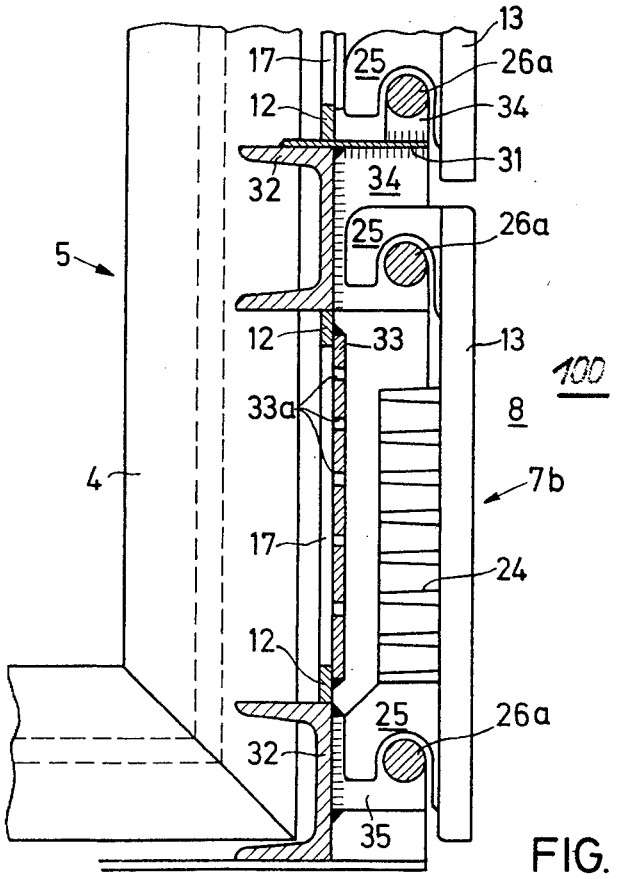
FIG. 10 shows a detail of FIG. 8.

FIG. 10 shows that partitions can be situated horizontally in the hollow front wall 7*b* of the box. Here a horizontal partition plate 31 of this kind is welded to a U-section member 32 which itself is welded to the frame 5 of the box, which frame comprises the T-section members 4. By one or more such horizontal partition plates 31 there are formed in the hollow interior of the front wall 7*b* between its closed plates 12 and its front plates 13 chambers which are situated one above another and are used for forming air speed zones situated one above another in a corresponding manner in the combustion chamber 100 after the grate drop 8, as will be explained hereinafter in more detail with reference to FIG. 11.

Perforated covering plates 33 with relatively narrow, round, throughflow apertures 33*a* are arranged within the front wall 7*b* in front of the slotted plates 12 and welded to these, so that vertical slots 17 of the slotted plates 12 are covered at the front. This causes an increase in flow resistance in the relevant air paths and thus also a corresponding pressure drop in the cooling air flowing along these, and this in turn results in a correspondingly lower blowing-out speed in the spaces between the neighbouring front plates 13. Such perforated plates 33 at the slotted plates 12 are preferably used only for a specific lower middle zone, situated between the two laterally outer zones, with a particularly low speed of flow as will also be explained in detail hereinafter with reference to FIG. 11.

The perforated plates 33 are only tacked to the slotted plates 12, preferably by means of short weld seams, so that they can easily be replaced by others having a higher or lower resistance to throughflow.

The front plates 13 in FIG. 10 are suspended by means of their hook-shaped rear projections 25 from round-section rods 26*a* which are held by vertical flat irons 34 and 35 respectively which are welded to the U-section members 32. The horizontal partition plate 31 is welded not only to one of the U-section members 32 but also to the flat irons 34.

Figure 11:
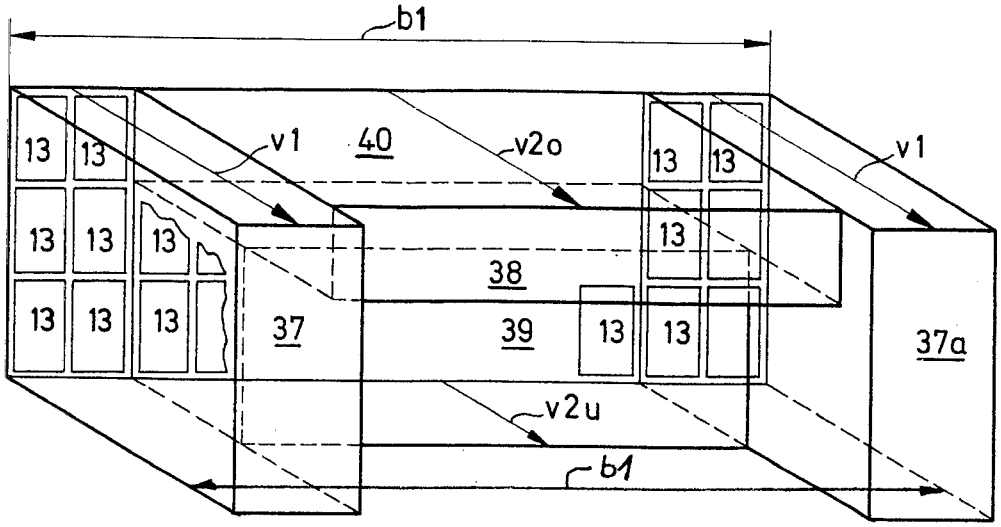
FIG. 11 shows in a diagrammatical perspective view the distribution of speeds of entry of the air front wall into the combustion chamber in the version of FIGS. 1, 8 or 9.

FIG. 11 shows a perspective view of the speed profile for the speed distribution after the grate drop 8 or 8*a* in the versions of FIGS. 1 to 10. This speed profile can be broken down into four prismatic boxes 37, 37*a*, 38 and 39 which, starting from a common substantially vertical plane 40 formed by the front surfaces of the front plates 13, extend to various distances forwards and thus represent zones of different flow speeds on the part of the air previously already used over the entire frontal area of the grate drop 8 as cooling air for plate cooling. In two laterally outer zones adjoining the two side walls 22 (see FIGS. 3, 7 and 9), these zones being represented by the two profile boxes 37 and 37*a*, prevails the highest flow speed *v*1 which occurs, a specific portion of the air flowing at this speed along the two side walls 22 and thus being used for cooling the side walls. In an upper middle zone represented by the profile box 38 a further portion of the air flows at a relatively low speed *v*2 *o* which is used as secondary air for the after-burning of the gaseous products of combustion above the fire bed, whilst in a lower middle zone represented by the profile box 39 a constant proportion of air flows at a still lower speed *v*2*u*, this being used as combustion air for the main combustion.

The three horizontal zones 37, 38/39, and 37*a* are formed by the vertical air guiding and distributing partitions (27 in FIGS. 1 and 7; 27*a* in FIG. 8; or 27*b* in FIG. 9) in conjunction with the vertical partition plates (29 in FIGS. 7 and 9); whilst the zones 38 and 39 are situated one above the other are formed by the horizontal partition plate (31 in FIG. 10) in conjunction with the perforated covering plates (33 in FIG. 10).

It will be appreciated that the various zones of the speed profile can be varied not only as regards their air speeds but also as regards their number, position, cross-sectional shape and cross-sectional size, that is to say width and/or height, so that the air economy in the combustion chamber in front of the grate drop can be adapted to the particular conditions desired there. Thus the speed profile composed of the individual profile boxes can be arranged three-dimensionally over the entire frontal area of the grate drop, like a mountain landscape. The individual cooling air fractions of the various zones can be determined as regards volume rate of flow V in m.$^3$/h. and therefore also in % of the total air requirements both by calculation, assuming specific directional speeds *v* in m/sec. for the individual zoner, and also for control purposes experimentally by measuring these air speeds for example by means of a bladed wheel anemometer held in front of the front plates 13, from the equation $V = v \times F$ in m.$^3$/h., F being the throughflow area of the relevant zone in m.$^2$.

A determining factor for the effective speed at which the air is blown out between adjacent front plates 13 into the combustion chamber is not only the size of the total throughflow area of the spaces 23 among the front plates 13 of the zone being considered, but also the pressure drop which is produced in the slotted plates 12 arranged on the path of flow of the air upstream of the front plates 13, and in the perforated plates 33 if used, and also for the zones 38 and 39 additionally in the vertical air guiding and distributing plates 27 and 27*a*. Thus for example the smallest speed *v*2*u* of the speed profile shown in FIG. 11 which prevails in the lower middle zone 39 results in the first instance from the pressure drop produced by the air guiding and distributing plates 27, 27*a* and 27*b*, and also, on the further advance of the air, from the pressure drop which is produced owing to the presence of the slotted plates 12, and finally from the increased resistance produced by the fact that the relevant vertical slots 17 of the slotted plates 12 are also covered by the perforated plates 33.

Figure 12:
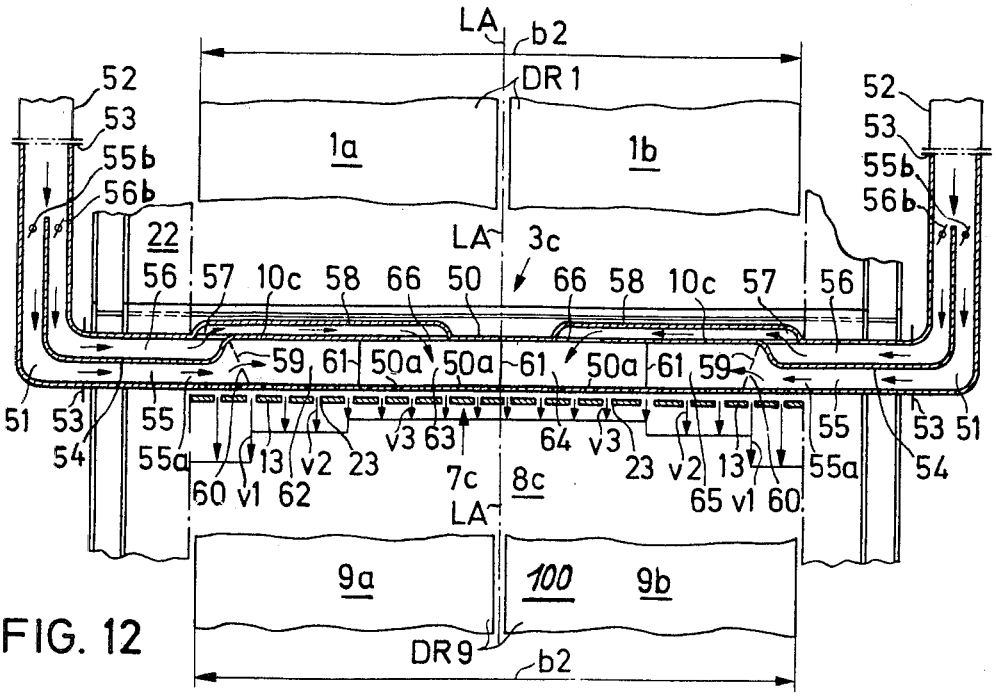
FIG. 12 shows a horizontal section through a further modified version having a double pre-drying grate and a double combustion grate.

FIG. 12 shows a version having an air distribution box 3*c* for a so-called "double grate" DR1, that is to say two grates 1*a* and 1*b* which are situated side-by-side directly adjacent each other, followed here by a double grate DR9 comprising two grates 9*a* and 9*b* also situated side-by-side directly adjacent one another and acting as the combustion device. The front wall 7*c* of the box 3*c* adjacent the combustion chamber 100 forms the grate drop 8*c* down which the material to be combusted descends suddenly from the discharge end of the double grate DR1 to the double grate DR9 which follows it. The distribution box 3*c* in this case comprises substantially a straight ducting box 50 preferably made from sheet metal and extending transversely of the central vertical longitudinal plane LA of the double grate DR1, and has a length equal to the overall width *b*2 of the double grate DR1, the ducting box 50, however, extending through the two side walls 22 of the incinerator and being connected at both ends by way of a duct leg 51 in each case to an air supply conduit 52. The two duct legs 51, which are preferably also made from sheet metal, can be connected by flange connections to the box 50 and the air supply conduits 52 as indicated at 53 in FIG. 12. A longitudinal partition plate 54 is arranged upright in each duct leg 51, and is continued into the relevant end portion of the straight box 50 and is connected there by a rearwardly bent portion to the rear wall 10*c* of the box 50. Each plate 54 forms in the relevant duct leg 51 and the adjoining end portion of the straight box 50 two part-ducts 55 and 56 which are situated one behind the other and of which the rear part-duct 56 is connected, by way of a throughflow hole 57 provided in the rear wall 10*c*, with a guide box 58 which is preferably also made of sheet metal and is connected in an air-tight manner to the rear wall 10*c* of the box 50. By means of two vertical transverse partitions 60 provided with throughflow holes 59 and also three vertical, transverse air-impervious partitions 61, there are formed within the box 50 four adjacent duct portions 62, 63, 64 and 65 which are adjoined to right and left, by a further duct portion 55*a* which on the one hand is bounded by the partition 60 and on the other hand is connected with the forward part-duct 55. Thus the grate drop 8*c* is supplied with air by way of a series of altogether six duct portions 55*a*, 62, 63, 64, 65 and 55*a*, and thus six part-flows of cooling air situated adjacent one another are blown out into the combustion chamber 100 over the entire double grate width *b*2 through the front wall 7*c* which is provided with throughflow apertures 50*a* and forms the grate drop 8*c*. The two external portions 55*a* receive their air directly from the two associated front part-ducts 55, whilst the two duct portions 62 and 65 which follow next are also supplied with air from the front partducts 55 through the partitions 60. On the other hand, the two middle duct portions 63 and 64 receive their air from the two rear part-ducts 56 by way of the associated guide boxes 58, as illustrated in FIG. 12 by suitable flow direction arrows. For in the rear wall 10*c* in addition to the throughflow holes 57 further throughflow holes 66 are also provided communicating with the guide boxes 58, so that the air can flow into the middle duct portions 63 and 64 from the rear part-ducts 56 by way of the guide boxes 58. In each of the two duct legs 51 there are provided in the entry regions of its two part-ducts 55 and 56 regulating elements — in this case there are preferably regulating flap valves 55*b* and 56*b* which can be adjusted independently of each other — with which the two air fractions flowing through the two part-ducts 55 and 56, and thus on the one hand the air quantities flowing through the duct portions 55*a* and 62 at the left or 55*a* and 65 at the right, and on the other hand flowing duct portion 63 or 64, can be regulated substantially independently of each other.

Cast rectangular front plates 13 are again hung, without additional fixing elements such as screws, locking bolts, or clips, or fixing by welding, on a suspension structure secured to the front portion of the duct box 50. Here again the front plates 13 are spaced from one another so that slot-shaped throughflow apertures 23 are left free between them.

In front of the grate drop 8*c*, that is to say downstream of the drop relatively to the air flow path, the six duct portions 55*a*, 62, 63, 64, 65 and 55*a* feed six adjacent zones with different air speeds, forming a speed profile with the speed vectors *v*1 -*v*2-*v*3-*v*3-*v*2-*v*1. With this speed profile, the highest air speed *v*1 again occurs in the region of each of the two side walls 22 of the incinerator. The object of this speed profiling and the formation of the speed profile have already been explained with reference to FIGS. 7 and 11. It should be noted that for the right-hand grate 9*b* of the double grate DR9 the associated profile part is the mirror-image of that profile part which is associated with the left-hand grate 9*a*. The entire speed profile which extends over the width *b*2 of the double grate DR9 is thus symmetrically shaped in relation to the longitudinal plane LA thereof, so that in its two middle zones which are associated with the two adjacent middle duct portions 63 and 64, the same air speed *v*3 prevails which is the lowest speed of the entire profile. This symmetry in relation to the central vertical longitudinal plane of the grate was also present in the profile shown in FIG. 7 and in the three-dimensional profile shown in FIG. 11. If temporarily different conditions prevail in the combustion chamber above the two grates 9*a* and 9*b* of the double grate DR9, by appropriately different adjustment of the regulating elements 55*b* and 56*b* it is possible to make the speed profile asymmetrical to meet the particular requirements. An automatic control of the regulating elements 55*b* and 56*b* in accordance with predetermined operating values of the incinerator or in dependence on the particular deviations from predetermined operating values of the incinerator is possible.

Figure 13:
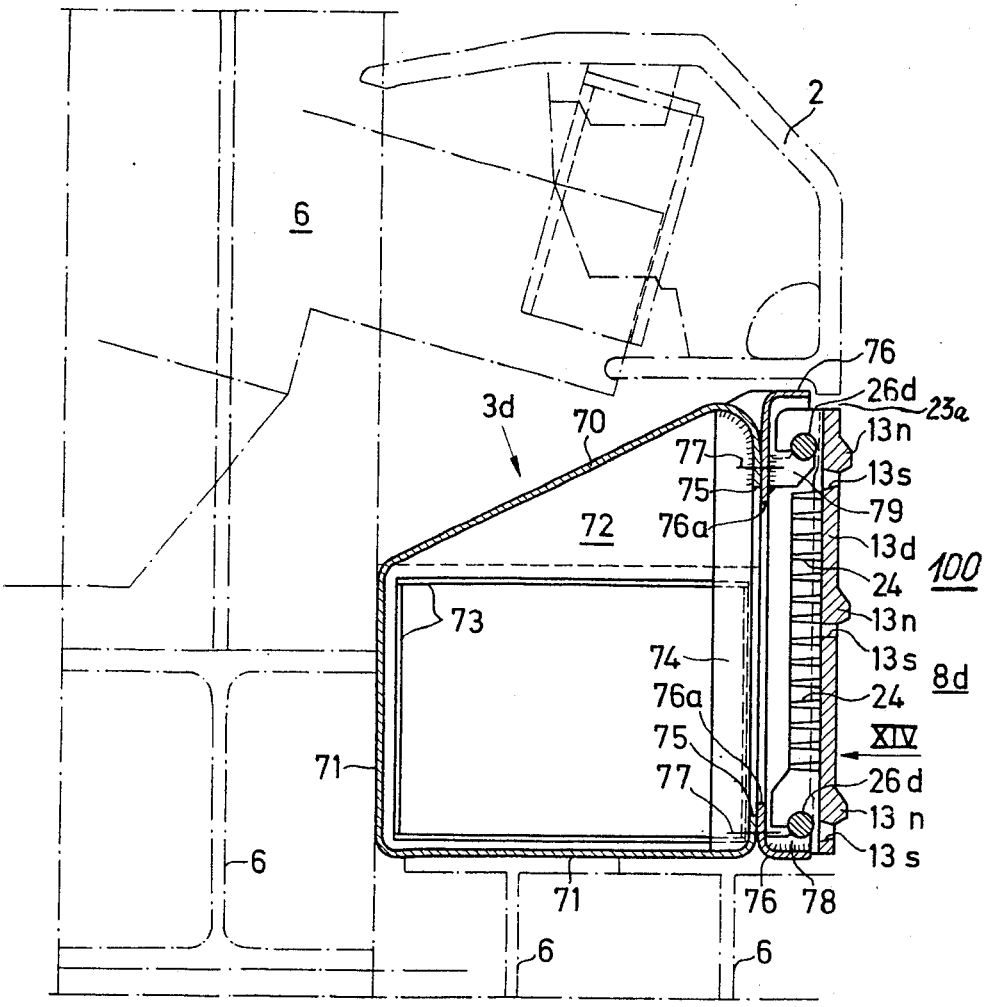
FIG. 13 shows a diagrammatic longitudinal vertical section through a yet further modified version in which the distribution box is constructed mainly from a bent steel plate.

FIG. 13 shows a version in which the air distribution box 3*d* includes a body 71 bent from steel plate. This body is closed at the rear and has front plates 13*d* hung at the front which in this case are themselves provided with throughflow apertures 13*s* for the air. Here the air distribution box 3*d* comprises a self-supporting housing 70 whereof the body 71 bent from a single metal plate forms the front, the rear, the roof and the floor. The housing 70 is closed at its two ends by respective flat end plates 72 welded onto the ends of the body 71. One of the two end plates 72 or, if there is lateral air introduction at both ends of the box 3*d*, each end plate 72 is provided with a rectangular aperture 73 for the entry of the cooling air into the housing 70. The housing 70 which comprises at the front welded-in vertical reinforcements 74, comprises simply at the front a relatively large rectangular aperture 75 through which not only is cooling air blown through and between the front plates 13*d* into the combustion chamber 100 after the grate drop 3*d*, but also — after removal of the plates 13*d* — the interior of the air distribution box 3*d* is accessible. The air guiding and distributing partitions which have already been explained and are therefore not shown in FIG. 13 are again arranged within the air distribution box 3*d*. A U-shaped bent plate 76 provided with a rectangular aperture 76*a* is bolted to the front of the body 71 at the points 77 and provided with welded-on, forwardly projecting flat iron sections 78 and 79 which carry two round — section iron rods 26*d* welded thereto. The front plates 13*d* which in this case are simply arranged in a single horizontal row, are hung on the two rods 26*d* in such a manner as to be readily removable. FIG. 13 again shows a discharge beam 2 of the pre-drying grate which is not shown here and also the I-sections 6 belonging to the furnace structure, the air distribution box 3*d* being adapted in its cross-sectional form to the furnace structure.

The front plates 13*d* are themselves provided with throughflow apertures in the form of horizontal slots 13*s* which are thus parallel to the cooling ribs 24, so that in this case the cooling air can be blown not only between adjacent front plates 13*d* but also through these plates themselves into the combustion chamber 100. Directly above the horizontal slots 13*s*, rib-like protective projections 13*n* are cast on to the front plates 13*b* and project in roof-like manner over the slots 13*s* and thus keep them free from downwardly trickling particles of ash or fuel.

Figure 14:
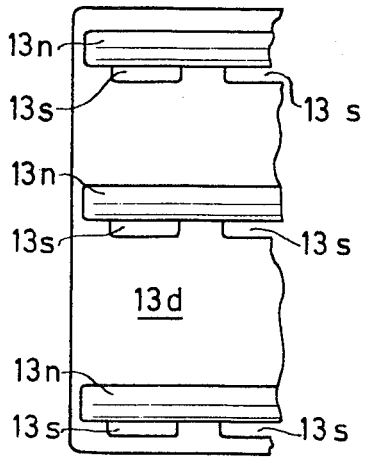
FIG. 14 shows a fragmentary front elevation of a front plate of the box taken in the direction of the arrow XIV of FIG. 13.
Figure 15:
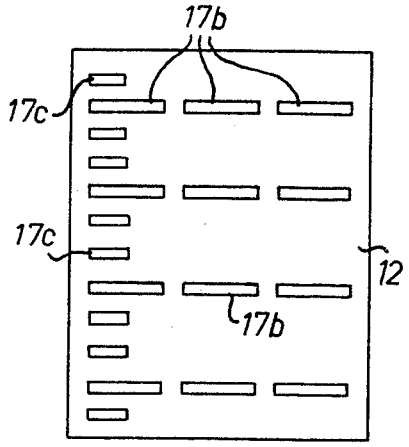
FIG. 15 is a front elevation view of a modified form of aperture plate for the rear part of a double front wall of an air distribution box of the general type shown in FIG. 1.

FIG. 14 shows a view from the front of one of the front plates 13*d* of FIG. 13. Here the slots 13*s* arranged in pairs at three different heights can be seen, and also the three protective projections 13*n* which are arranged immediately above them. Horizontal slots may also be used for the plates 12 of the rear portion of the double wall of the air box in the type of construction shown in FIG. 1. FIG. 15 illustrates a plate 12 for such a structure, showing horizontal slots 17*b* serving as air throughflow apertures. The plate illustrated is one at the lateral ends of the array and has additional slots 17*c* near one edge to provide a higher speed air flow zone at the edge of the combustion chamber.

Figure 16:
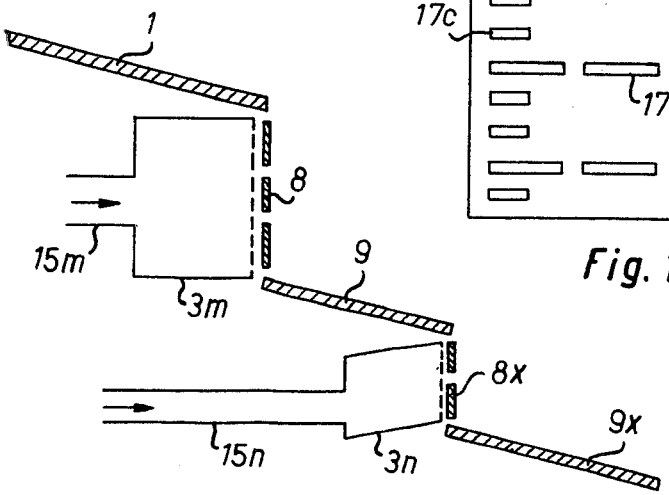
FIG. 16 is a diagrammatic longitudinal section of a modified form of combustion apparatus according to the invention in which there is a first aerated drop from the pre-drying grate through a first combustion grate, followed by a second aerated drop to a second combustion grate.
Figure 17:
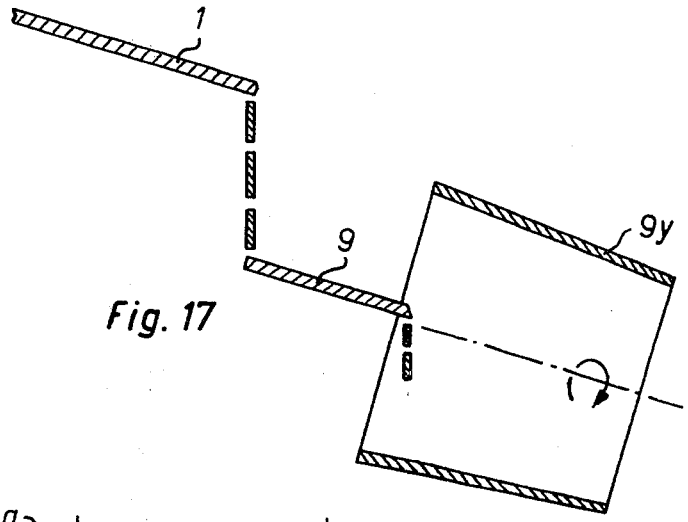
FIG. 17 is a diagrammatic longitudinal section of part of a modified form of combustion apparatus in which there is a first aerated drop to a combustion grate, followed by a second aerated drop to a rotatable drum forming part of the combustion device.

Several other versions different from those described hereinbefore are feasible. For example, the combustion device 9 following the grate 1 can consist of a rotary drum instead of consisting of a second grate, the discharge end of the grate 1 projecting into the drum. Instead of only a single inclined grate 9 following the grate 1, two inclined grates 9 and 9*x* could be provided as shown in FIG. 6, in which case the grate 9 following the grate 1 is also provided at its discharge end with an aerated drop 8*x* provided by a second air distribution box 3 or of a kind already described. As diagrammatically shown in FIG. 16, the first air distribution box 3*m*, supplying air to the perforated front wall 8, is provided with air supply means 15*m* and the second air distribution box 3*n*, supplying air to the second perforated front wall 8*x*, has its own air supply means 15*n*. Between the first grate 1 and a rotary drum, it would also be possible, as shown in FIG. 7, to interpose a second inclined grate 9 whose discharge end projects into the rotary drum 9*y* and is provided within the drum with such an air distribution box forming a grate drop. The air distribution boxes supplying air for aerating the drop walls 8 and 8*x* have been omitted in FIG. 17 in order to simplify the illustration. Similarly, three or more grates can be arranged to precede a rotary drum with a grate drop in each case between the grates and between the last grate and the rotary drum, and each drop can be provided by such an air distribution box.

Instead of the two air guiding and distributing plates 27 arranged at an angle to each other in FIG. 7, it is possible to use a single air guiding and distributing plate bent at a suitable angle.

To form zones which are adjacent one another horizontally, it would be sufficient to use the vertical air guiding and distributing partitions (27 and 27*b* in FIGS. 7 and 9) arranged within the air distribution box or the vertical partition plates (29 in FIGS. 7 and 9) arranged in the hollow front wall (7 in FIGS. 7 and 9), by themselves in each case. However, the use of both of these kinds of partitioning is advantageous in the interests of substantial channelling of the various air flows for forming zones, especially since each of the two kinds involves only slight material, production and fitting costs. In any case, the pressure drop which takes place in the individual air paths, and therefore the increased resistance which is produced there, are determining factors for the effective air speed *v* and thus for the quantitative air fraction in $m^3/h$ in each zone.

If the interior of the box 3 shown in FIG. 1 is to be accessible at its rear as well as at its front to carry out work in this interior, the frame 5 should be welded to be self-supporting. Instead, the box may be made accessible only at its rear or at its front.

Instead of providing the air distribution box with a frame welded together from section members as explained with reference to FIG. 1, it could be made self-supporting and mounted on bearing brackets of the I-section members 6, in which case the frame would be longer be necessary.

Figure 18:
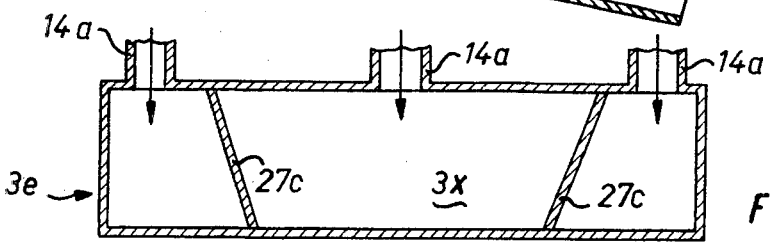
FIG. 18 is a horizontal cross-section of a modified form of air distribution box with air-tight vertical partitions and individual air supply means for the respective chambers of the air distribution box.

Instead of providing the air guiding and distributing partitions with throughflow apertures for the cooling air as shown in FIG. 1 and FIG. 7, these partitions could be made impervious to air; in that case, however, as shown in FIG. 18, it would be insured by several appropriately arranged air supply conduits 14*a* that the chambers formed in the air distribution box by the air guiding and distributing partitions 27*c* receive their shares of air in spite of this.

Instead of welding the suspension structure for the front plates to the frame of the air distribution box, as has been explained with reference to FIG. 1, it could be welded to the slotted plate (12 in FIGS. 1 and 7) and assembled jointly therewith on the air distribution box, preferably by screwing.

Instead of producing the uppermost front plates 13 and the discharge shoulder as separate members and providing an air gap between the plates and the shoulder (see FIG. 1), the shoulder can be made of discharge blocks integral with these respective front plates, that is to say, each block together with a front plate can be made as a single casting, with a slot cast-in instead of the air gap.

Instead of arranging the front plates in several rows, for example, three rows one above the other, as shown in FIG. 1, it is possible to provide only a single horizontal row of front plates.

In the construction shown in FIG. 7, the vertical partition plates 29 could also be taken through the air distribution box 3 and sub-divide the box into chambers situated side by side. In this case the air guiding and distributing partitions 27 in FIG. 7 would be omitted. The chambers thus formed would then be supplied individually with cooling air through separate air inlet conduits which are connected to the rear wall 10 of the air distribution box 3. In the case of FIG. 7 the two partition plates 29 would form in this way three box chambers and, therefore, three separate air inlet conduits would have to be connected to the rear wall 10, as shown in FIG. 18 with regard to the partitions 27*c* and the inlet conditions 14*a*. The air inlet conduits for the two external chambers, however, could instead be connected to the ends of the air distribution box.

The step forward in technical progress achieved by the combustion apparatus described consists in that, in the region of the combustion device arranged downstream of the pre-drying grate, owing to the speed profile for the cooling air which can even be differentiated three-dimensionally, a uniform firing effect can be obtained and the material can be completely burned out, and by the particularly effective selective cooling of the apparatus side walls it is now possible to obviate slag accretions which can readily occur particularly in the region of the grate drop, and a uniform temperature field can be obtained in the combustion chamber, that is to say there is obviated the risk of local high temperature peaks which tend to subject the constructional parts concerned to undesirably high thermal stresses, having a very bad effect on the working life of such parts. These advantages are all the more important since they can be achieved with a really economical and very sparing air budget, relatively large quantities of air being provided only at those places where it makes sense to use them from the cooling point of view, so that as regards the actual burning operation it is only necessary to provide the total air requirements which are necessary, avoiding disadvantageously high surplus quantities of air. As regards the cooling effect achieved it should be noted that this is due not only to the quantity of air concerned but also the speed of the air, since with a high speed with appropriately high turbulence in the flow the heat transfer rate (in $Kcal/m^2h°C$) and thus the cooling effect are correspondingly high. Not the least important advantage is that the components required involve only a small outlay as regards material and expense, since they can be produced for the greater part from metal plate or sheet.

We claim:

1. A combustion apparatus, comprising a pre-drying grate (1, DR1), a combustion device (9, DR9) following the grate (1, DR1), a combustion chamber (100) above said device (9, DR9), and a drop (8, 8*a*, 8*c*, 8*d*) which is intermediate the grate (1, DR1) and the combustion device (9, DR9) and down which material to be combusted falls, wherein there is the improvement that:

at least part of said drop (8, 8*a*, 8*c*, 8*d*) is constituted as a front wall (7, 7*a*, 7*b*, 7*c*) of an air distribution box (3, 3*a*, 3*b*, 3*c*, 3*d*) extending over substantially the whole width (*b*1, *b*2) of the grate (1, DR1) and connected to air supply means (14, 15, 30, 51, 52)

for supplying air to said box (3, 3a, 3b, 3c, 3d), and said wall (7, 7a, 7b, 7c) is provided with air throughflow apertures (13s, 17, 17a, 23, 33a, 50a, 75, 76a) so dimensioned that air passes from said box (3,3a, 3b, 3c, 3d) to said chamber (100) in zones of different air speed, including zones of relatively higher air speed on each lateral side of said combustion chamber.

2. A combustion apparatus according to claim 1, wherein air guiding partition means (27, 27a, 27b, 60, 61) are provided in said box (3, 3a, 3b, 3c).

3. A combustion apparatus according to claim 2, wherein said air guiding partition means (27, 27a, 27b, 60) are formed with perforations therethrough (28, 59).

4. A combustion apparatus according to claim 2, wherein said air guiding partition means (27, 27a, 27b, 60, 61) are substantially vertical, whereby the formation of first and second horizontally adjacent air flow zones (37, 38/39, 27a, 55a, 62, 63, 64, 65) of different air flow velocity in said chamber (100) in front of said front wall (7, 7a, 7b, 7c) is fostered.

5. A combustion apparatus according to claim 2, wherein said air guiding partition is substantially impervious to air and divides said box (3, 3a, 3b) into first, second and third chambers, and said air supply means communicates with said first, second and third chambers.

6. A combustion apparatus according to claim 1, wherein said front wall (7, 7a, 7b, 7c) is a hollow wall.

7. A combustion apparatus according to claim 6, wherein first and second substantially vertical partitions (29) are arranged in said hollow all (7, 7a, 7b), whereby first, second and third horizontally adjacent air flow zones (37, 37a, 38/39) are formed in said chamber (100) in front of said hollow wall (7, 7a, 7b).

8. A combustion apparatus according to claim 6, wherein a substantially horizontal partition (31) is arranged in said hollow wall (7b), whereby first and second vertically adjacent air flow zones (38, 39) of different air flow velocities are formed in said chamber (100) in front of said hollow wall (7b).

9. A combustion apparatus according to claim 6, wherein air guiding and distributing means (17, 17a, 23, 27, 27a, 27b, 28, 31, 33, 33a) partitioning the interior of said box (3, 3a, 3b) and the interior of said front wall (7, 7a, 7b) and formed in said front wall (7, 7a, 7b) form in said chamber (100) in front of said front wall (7, 7a, 7b) the following air flow zones:

i. two laterally outermost zones (37, 37a) of highest air flow speed, ii. and upper middle zone (38) of intermediate air flow speed, and iii. a lower middle zone (39) of lowest air flow speed.

10. A combustion apparatus according to claim 6, wherein a rear part of said hollow wall (7, 7a, 7b) comprises upwardly extending plate means (12) formed with some (17, 17a) of said air throughflow apertures (17, 17a, 23, 33a).

11. A combustion apparatus according to claim 10, wherein the air throughflow apertures (17, 17a) formed in said plate means (12) are slots.

12. A combustion apparatus according to claim 11, wherein said slots (17, 17a) are substnatially vertical.

13. A combustion apparatus according to claim 11, wherein said slots (17b, 17c) are substantially horizontal.

14. A combustion apparatus according to claim 10, wherein some of the air throughflow apertures (17, 17a) formed in said plates (12) are covered by covering members (33) formed with further air throughflow apertures (33a).

15. A combustion apparatus according to claim 10, wherein laterally outermost parts of said plate means (12) have a greater air throughflow capacity per unit area than do middle parts of said plate means (12).

16. A combustion apparatus according to claim 6, wherein a front part of said hollow wall (7, 7a, 7b, 7c) comprises an assembly of upwardly extending front plates (13, 13d) hung by frame means (26, 26a, 26d).

17. A combustion apparatus according to claim 16, wherein said front plates (13) are spaced apart so as to leave thereamong air throughflow gaps (23) forming some of said air throughflow apertures (17, 17a, 23, 33a, 50a).

18. A combustion apparatus according to claim 16, wherein said front plates (13, 13d) are provided with substantially horizontal cooling ribs (24) at their rears.

19. A combustion apparatus according to claim 16, wherein said grate (1, DR1) terminates in a transverse discharge shoulder (2) at said drop (8, 8a, 8c, 8d), and said front plates (13, 13d) are so constituted that they can be removed from and re-hung on said frame means (26, 26a, 26d) without detachment or unseating of said discharge shoulder.

20. A combustion apparatus according to claim 16, wherein, at said drop (8, 8a, 8c, 8d) said grate (1, DR1) terminates in a transverse discharge shoulder (2) having a substantially vertical front face, said assembly of upwardly extending front plates (13, 13d) adjoining said front face immediately below said front face but being spaced from said front face so as to leave an air throughflow aperture (23a) of said apertures (13s, 17, 17a, 23, 23a, 23b, 23c, 33a, 50a, 75, 76a).

21. A combustion apparatus according to claim 16, wherein each of said upwardly extending front plates (13d) has formed therethrough an air throughflow aperture (13s) of said appertures (13s, 75, 76a).

22. A combustion apparatus according to claim 21, wherein each of said upwardly extending front plates (13d) has formed on the front side thereof a protective projection (13n) covering said air throughflow aperture (13s) from above.

23. A combustion apparatus according to claim 16, wherein the front plates (13, 13d) of said assembly are arranged in at least one transverse horizontal row.

24. A combustion apparatus according to claim 1, wherein an air inlet conduit (15) is connected to a rear wall (10) of said box (3, 3a) substantially centrally of the width (b1) of said box (3, 3a).

25. A combustion apparatus according to claim 1, wherein first and second air inlet conduits (30, 52) are connected to respective opposite ends of said box (3b, 3c).

26. A combustion apparatus according to claim 1, wherein said box (3, 3a) comprises a skeleton frame (5) and walls (7, 7a, 10) including said front wall (7, 7a) mounted on said frame (5).

27. A combustion apparatus according to claim 26, wherein a rear wall (10) of said walls (7, 7a, 10) comprises cover means (11) hingedly connected to said frame (5), and locking means (19, 20) for locking said cover means (11) in a closed condition.

28. A combustion apparatus according to claim 26, wherein said walls (7, 7a, 10) are at least partly detachable readily from said frame (5).

29. A combustion apparatus according to claim 28, wherein said front wall (7, 7a) comprises upwardly extending rear plate means (12) formed with some of said apertures (17, 17a, 23) and readily detachable from said frame (5), and upwardly extending front plates (13) formed with others of said apertures (17, 17a, 23) and hung on a suspension structure (26) connected to said frame (5).

30. A combustion apparatus according to claim 26, wherein said frame (5) is self-supporting and said front wall (7, 7a) and a rear wall (10) of said walls (7, 7a, 10) are readily detachably mounted on said frame (5).

31. A combustion apparatus according to claim 1, wherein said combustion device (9, DR9, 9x, 9y) comprises a drum (9y).

32. A combustion apparatus according to claim 1, wherein said combustion device (9, DR9, 9x, 9y) comprises a second grate (9, DR9).

33. A combustion apparatus according to claim 32, wherein said combustion device (9, DR9, 9x, 9y) comprises a third grate (9x), a second drop (8x) which is intermediate the second grate (9, DR9) and the third grate (9x) and down which said material falls from said second grate (9, DR9) to said third grate (9x), a second air distribution box (3n) extending over substantially the whole width of the second grate (9, DR9), and second air supply means (15n) connected to the second box for supplying air thereto, a front wall of said second box forming at least part of said second drop and having its outer surface facing said combustion chamber (100), said front wall of said second box being provided with air throughflow apertures whereby air passes from said second box to said chamber (100).

34. A combustion apparatus according to claim 32, wherein said combustion device (9, DR9, 9x, 9y) comprises a drum (9y), a second drop (8x) which is intermediate the second grate (9, DR9) and the drum, and down which said material falls, a second air distribution box (3n) extending over substantially the whole width of the second grate (9, DR9), and second air supply means (15n) connected to the second box for supplying air thereto, a front wall of said second box forming at least part of said second drop and having its outer surface facing said combustion chamber (100), said front wall of said second box being provided with air throughflow apertures whereby air passes from said second box to said chamber (100).

35. A combustion apparatus according to claim 1, wherein said box (3d) comprises a tubular part (70) extending transversely of said grate and formed by bending a single metal plate (71), and end parts (72) at the ends of said tubular part (70) and formed by end plates (72).

36. A combustion apparatus according to claim 1, wherein said grate (1, DR1) is a double grate (DR1); said box (3c) is connected at its ends to respective air supply ducts (51) of said air supply means (51, 52); said box (3c) is divided by transverse partitions (60, 61) into duct portions (55a, 62, 63, 64, 65); said air supply ducts (51) are each divided by a longitudinal partition (54) into first and second part-ducts (55, 56); and the first part-ducts (55) are connected to laterally outer duct portions (55a, 62, 65) of said duct portions (55a, 62, 63, 64, 65), and the second part-ducts (56) are connected to laterally inner duct portions (63, 64) of said duct portions (55a, 62, 63, 64, 65).

37. A combustion apparatus according to claim 36, wherein said laterally outer duct portions (55a, 62, 65) comprises first and second laterally outer duct portions (55a, 62) to each side of said laterally inner duct portions (63m 64) and separated by one of said transverse partitions (60, 61) which one partition (60) is formed with through holes (59).

38. A combustion apparatus according to claim 36, wherein an air flow regulating element (55b, 56b) is provided in each of said part-ducts (55, 56).

39. A combustion apparatus according to claim 6, wherein air guiding and distributing means (17, 17a, 23, 27, 27a, 28) partitioning the interior of said box (3, 3a) and formed in said front wall (7, 7a) form in said combustion chamber (100) in front of said front wall (7, 7a) the following air flow zones:

i. two laterally outermost zones (37, 37a) of highest air flow speed,
ii. an upper middle zone (38) of intermediate air flow speed, and
iii. a lower middle zone (39) of lowest air flow speed.

* * * * *